United States Patent [19]

Böling

[11] 3,999,026

[45] Dec. 21, 1976

[54] HEATING DEVICE FED WITH MICROWAVE ENERGY

[75] Inventor: Göran Böling, Taby, Sweden

[73] Assignee: Stiftelsen Institutet for Mikrovagsteknik vid Tekniska Hogskolan, Stockholm, Sweden

[22] Filed: Feb. 13, 1975

[21] Appl. No.: 549,757

[30] Foreign Application Priority Data

Feb. 22, 1974 Sweden ..... 7402373

[52] U.S. Cl. ..... 219/10.55 A; 219/10.55 F

[51] Int. Cl.[2] ..... H05B 9/06

[58] Field of Search ..... 219/10.55 A, 10.55 F, 219/10.81; 338/98 R

[56] References Cited

UNITED STATES PATENTS

| | | | |
|---|---|---|---|
| 2,545,106 | 3/1951 | Parker | 219/10.55 F |
| 3,397,296 | 8/1968 | Curran | 219/10.55 F |
| 3,493,709 | 2/1970 | Lavdo et al. | 219/10.55 F |
| 3,495,062 | 2/1970 | Püschner | 219/10.55 A |
| 3,549,849 | 12/1970 | Boehm | 219/10.55 F |
| 3,555,232 | 1/1971 | Bleackley | 219/10.55 F |
| 3,731,038 | 5/1973 | Bosisid | 219/10.55 A |
| 3,764,770 | 10/1973 | Saad et al. | 219/10.55 F |
| 3,783,221 | 1/1974 | Soulier | 219/10.55 A |

*Primary Examiner*—Arthur T. Grimley
*Attorney, Agent, or Firm*—Silverman & Cass, Ltd.

[57] ABSTRACT

A heating device has a resonator divided into at least two parallel chambers by a separating wall. The separating wall is connected to a microwave energy source at at least one point on one edge of said wall whereby a magnetic field is generated along the opposite edge of said separating wall. The corresponding electrical field heats the material desired to be heated. A slot may be provided in the resonator wall above the edge of the separating wall. Two more parallel chambers may be placed above the first two chambers with a corresponding slot parallel to the first slot. The material to be heated may then be placed into the second corresponding slot. The chambers may be provided with cooling elements disposed generally parallel to the separating wall.

15 Claims, 11 Drawing Figures

HEATING DEVICE FED WITH MICROWAVE ENERGY

BACKGROUND OF THE INVENTION

The present invention relates to a heating device which is fed with microwave energy. The device can be used for example for jointing pieces of plastic material or plastic coated cardboard by welding or by drying and hardening of glue when sealing packages for example.

In order to obtain a good heat sealing joint, the heating must be even along the whole part of the heating object where the joint is to be located. In those cases where the heating is made under continuous transport of the material at a constant speed, it is not so necessary that the heating is even in each point along the whole length of the heating device. Because of the continuous movement, the parts that have passed the heating device receive the same total amount of heat, even though the heating varies along the heating zone. In case the feeding is stepwise and in those cases when the heating object is stationary relative to the heating device during the heating, it is however absolutely necessary that the heating device gives an even heating. If the joint is to be of high quality it is also necessary that the heated edges are forcefully pressed together. In an automatic high-speed production process there are high demands on fast heating and fast pressing together and cooling of the joint also may be necessary. Cooling is necessary in those cases, where plastic coated materials are joined. The plastic is melted and the joint is not strong until the plastic material is cooled to setting temperature.

The pressing together can be made in several ways. The heating device can be constructed to exert a pressure by itself at the same time as the heating is made. Alternatively the pressing together can be made at a later time.

When heat sealing packagings of paper or cardboard a method has been used up to now, for example, in which heat is transmitted by pressure of heat jaws. In this method the heat must be conducted through the material, which makes the process slow. The highest temperature will be on the surface of the material and not in the joint, and the surface temperature must be kept under a certain limit so that the material will not be damaged. In another method used when heating can be made during movement of a heating object along a transport track, the heating is made by hot air from for example a gas flame. In this method it is, however, difficult to prevent the product in the packaging from being damaged by the hot air. Furthermore there is a great risk of fire if the process is disturbed in some way. Experiments have also been made, in which high frequency welding has been used, particularly at frequencies of 13 or 27 MHz. At these relatively low frequencies it has been necessary to use high field intensities with risks for leakages or to accept a long process time.

At microwave heating, at a frequency of for example 2450MHz, the heating can be made approximately 100 times as fast as at the high frequency heating mentioned above when using the same field intensity. By using a wave guide provided with a slot, glue or plastic coating can be heated by microwave energy in a relatively simple way. It is a problem, however, to get an even heating over a distance long enough to be particularly usable. In every kind of wave guide the heating is uneven, which is caused by energy being absorbed by the heating object along the wave guide and also by standing waves occurring in the wave guide. Furthermore it is difficult to use cooling elements of metal in this heating device, as the cooling elements will influence the function of the wave guide. Cooling elements of ceramic or plastic material can be used, but the cooling effect of such cooling elements is often unsatisfactory due to the relatively low heat conducting ability of said materials.

The present invention relates to a heating device which, when fed by microwave energy, will produce an even heating in a longitudinal heating area when heating stationary as well as moving objects. According to the invention this is provided by an electric field which is produced in the heating device and constant over the whole heating zone.

The heating device can, if required, be provided with cooling elements of metal, which cool the joint effectively immediately after the feeding of microwave energy has been broken, and the joint can be under pressure until it is sufficiently cooled.

SUMMARY OF THE INVENTION

A device according to the invention for producing a field of the kind described above comprises a resonator divided into two parallel chambers by a metal wall, and in which the feeding of microwave energy takes place in such a way that the magnetic field is forced to close itself around said metal wall. If said chambers have the same shape and if the resonator has a constant cross section along the whole length of the device, a constant magnetic field intensity will be obtained close to the metal wall, and the electric field belonging to the magnetic field will produce an even heating in a dielectrically homogeneous material.

BRIEF DESCRIPTION OF THE DRAWING

The invention will be closer described below with reference to the attached drawings.

FIG. 7 and FIG. 8 show the two embodiments with cooling elements of metal, in which FIG. 8 shows the resonator on a larger scale then FIG. 7.

DESCRIPTION OF THE PREFERRED EMBODIMENT

Figure 1:
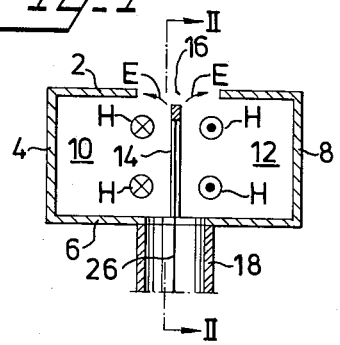
FIG. 1 shows schematically a resonator in cross section.
Figure 2:
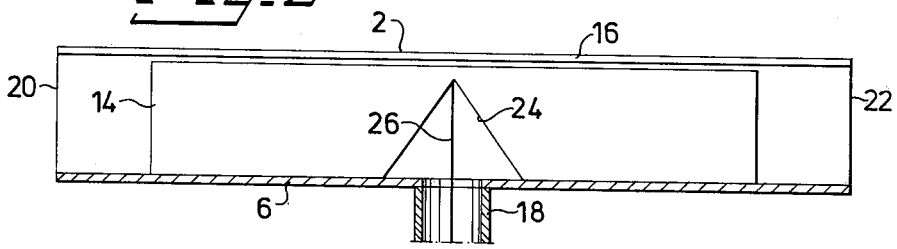
FIG. 2 is a longitudinal sectional view of the same resonator as seen at the line II—II in FIG. 1.
Figure 7:
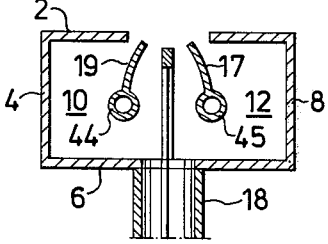

FIGS. 1, 2 and 7 show the first of the illustrated embodiments. The resonator is limited by longitudinal walls 2, 4, 6 and 8. The longitudinal wall 2 is provided with a slot 16 and the resonator is divided into two chambers 10 and 12 by a separating wall 14. FIG. 2 shows an example of how microwave energy can be fed into the device in a suitable way. In the wall 14 there is a V-shaped recess 24. A conductor 26 is connected to the top of said recess. The other end of the conductor is connected to a wave guide so that it will surround a magnetic field. This will produce a current in the conductor, which current will continue into the separating wall 14 and produce another magnetic field closing around said wall 14. The electric field belonging to the magnetic field will have a constant intensity along the whole length of the slot 16. At a certain movement the electric field will extend from the free edge of the wall 14 to the edges of the wall 2 situated on both sides of the separating wall, as shown in FIG. 1 by arrows designated E. At the same moment the magnetic field will extend perpendicular to the plane of the paper, as shown by arrow points and ends, designated H. If a dielectrically substantially homogenous material is located close to the slot 16 it will be heated substantially evenly along the whole length of the slot.

FIG. 7 shows how the heating device according to FIG. 1 can be provided with cooling elements of metal. Two longitudinal metal elements 17 and 19 serves as cooling elements. They extend perpendicular to the electrical field, so that they will influence the function of the heating device as little as possible. The lower parts of the cooling elements can be provided with tubes 44 and 45, in which a cooling medium flows. The cooling elements must not touch the walls of the resonator or may only have contact with the walls along a small part of their lengths. The cooling elements can be attached for example through a dielectric material having small dielectric losses, for example a material marketed under the trademark Teflon, which fills out the chambers 10 and 12. The device will produce good heating with or without cooling elements.

Figure 3:
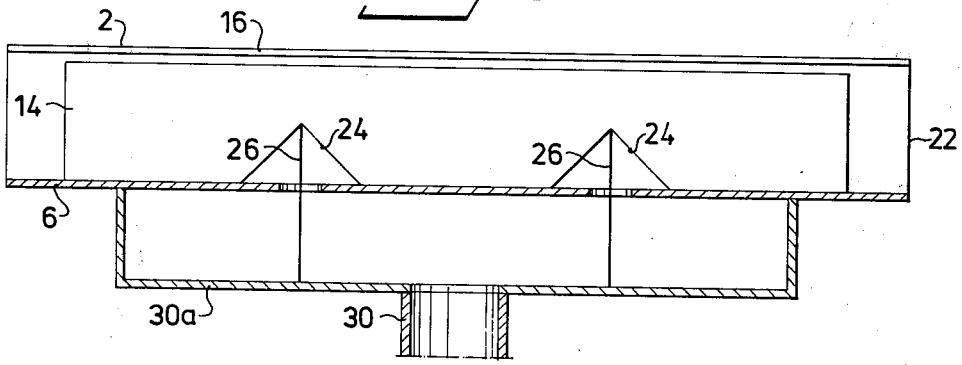
FIG. 3 is a longitudinal sectional view of a modified embodiment of a resonator.

A long resonator can preferably be fed at two or several points. In FIG. 3 such a feeding by a waveguide T is shown. The feeding energy must have the same phase in the two feeding points. Consequently the distance from the branch point, where the waveguide 30 which forms the stem of the T is connected to the head 30*a* of the T, to each feeding point is equal. At each feeding point there is a V-shaped recess 24 in the wall 14 and a conductor 26.

Figure 4:
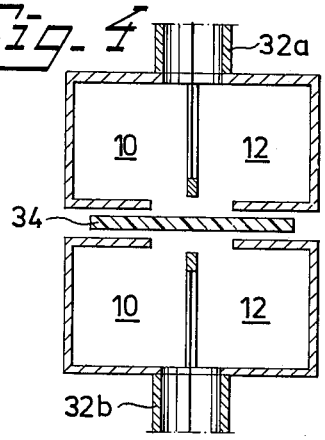
FIG. 4 is a cross sectional view of an embodiment with two resonators for heating of both sides of a material.

It is possible to arrange two resonators opposite each other as shown in FIG. 4. This can be done in order to increase the effect on a short distance or to increase the heat homogenity when heating a thick material 34. For the later purpose it may be sufficient to feed only one resonator. The feeding conductors of the other resonator should then be short-circuited. Another advantage of using two resonators is, that leakage radiation will be further decreased.

Figure 6:
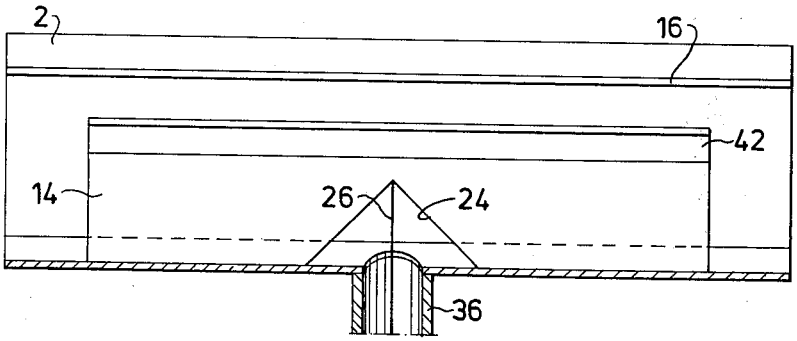
FIG. 5 is a schematic cross sectional view on a enlarged scale and FIG. 6 is a schematic longitudinal sectional view of another embodiment of a resonator.
Figure 5:
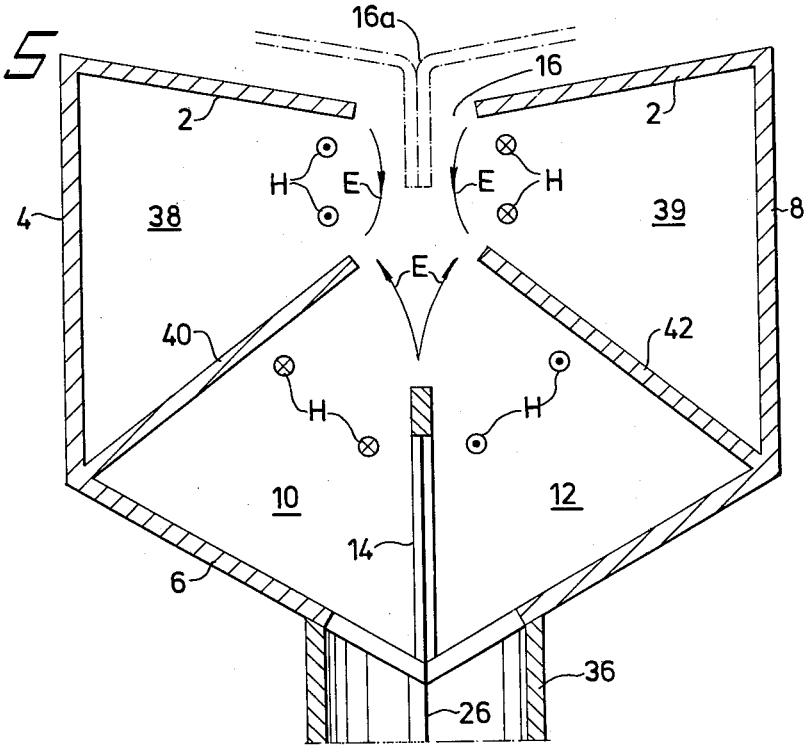
Figure 8:
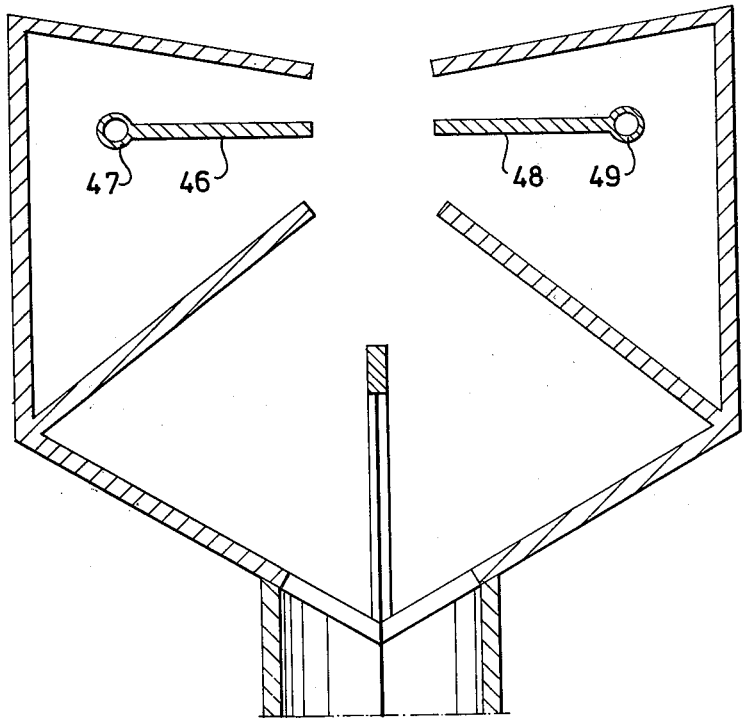

The second illustrated embodiment is shown in FIGS. 5, 6 and 8. Further to the two resonator chambers 10 and 12 corresponding to the chambers 10 and 12 of the embodiment already described, there are two further chambers 38 and 39 symmetrically located on both sides of the separating wall 14, which is fed by the feeding device. The magnetic field in the chambers 10 and 12 closes around the separating walls 40 and 42 in the same way as the wall 14. The electric field belonging to said magnetic field will at a certain moment extend from the free edge of the wall 14 to the free edges of the walls 40 and 42 and from the free, inwardly directed edges of the wall 2 to said edges of the walls 40 and 42 as is shown by the arrows designated E in FIG. 5. The magnetic field will at the same moment extend perpendicular to the plane of the paper, as is shown by the arrow points and ends designated H. The electric field in the slot 16 thus has a direction parallel to the separating wall 14. This embodiment is consequently suitable for heating materials which can be inserted into the slot 16. FIG. 5 shows how, for example, two plastic coated cardboard pieces 16*a* can be heated to be jointed by welding. The construction of the device, where the electric field is directed perpendicular to the plane of the surface in which the slot is situated, results in extremely little leakage radiation.

The feeding of microwave energy can be made in the same way as in the first embodiment, as is shown in FIG. 6.

Also the second embodiment can be provided with cooling elements, see FIG. 8. The metal walls 46 and 48 are located perpendicular to the electric field and can lead away heat from the joint. Their ends opposite the joint are provided with tubes 47 and 49, through which a cooling medium flows. These cooling elements can be attached in the same way as in the device described above. In both devices more cooling elements, than those shown in the drawings, can be arranged in the resonator chambers if further cooling is required.

Also, as mentioned above, pressing together and cooling are important when joining together plastic or glue coated materials.

When a double heating device is used, see FIG. 4, the pressing together can be made between the two resonators. The slots of the heating devices can be covered or filled by a material with low losses of plastic or ceramic. Cooling elements may or may not be provided, see FIG. 7, depending on the cooling requirements. Only one or both resonators may have cooling elements.

In the device according to FIG. 1 pressure can be made against for example a plate of plastic or ceramic with low losses. The pressing together may also be made by the joint, after the heating object having passed the heating device, being moved in between for example metal jaws while the joint is still warm, and pressed together by the metal jaws at the same time as the jaws cool the joint. For the lastmentioned purpose the jaws may be cooled by for example water. This is also suitable for the device according to FIG. 5.

Still another way of pressing together, particularly for sealing packages on continuous lines, is to arrange one or several pairs of wheels or rolls, between which the joints passes immediately after the heating.

Figure 9:
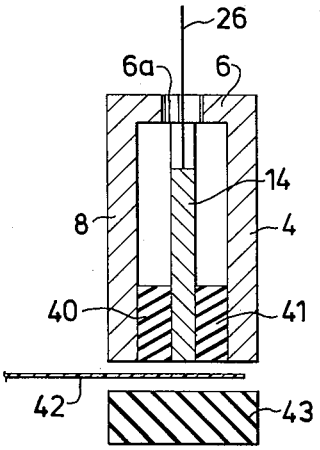
FIG. 9 is a cross sectional view of still another embodiment of the invention.
Figure 10:
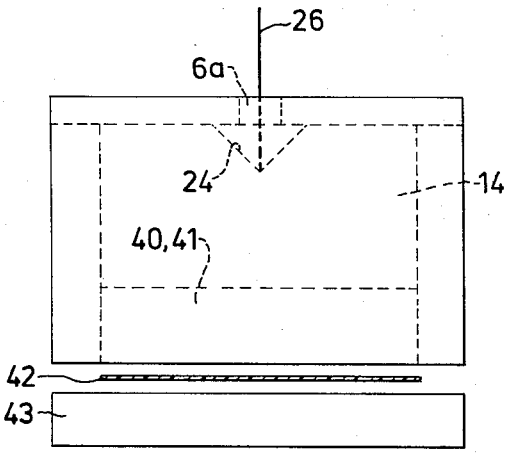
FIG. 10 is a longitudinal view of the embodiment shown in FIG. 9.
Figure 11:
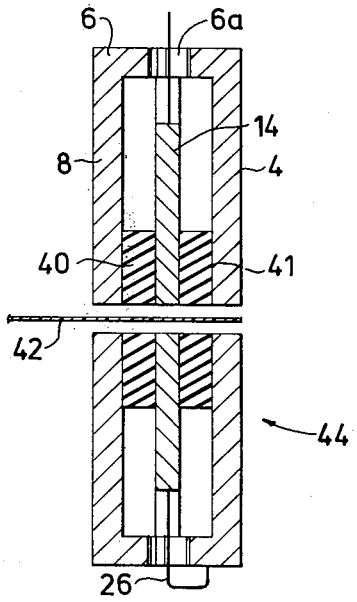
FIG. 11 is a cross sectional view of a further embodiment of the invention.

In a third embodiment of the invention the device comprises a resonator with a longitudinal cavity limited by three parallel walls, as shown in FIGS. 9, 10 and 11.

The device according to FIGS. 9 and 10 comprises a longitudinal resonator cavity limited by three walls 4, 6, 8 corresponding to the walls in the device according to FIG. 1 with the same reference numbers. A separating wall 14, the length of which preferably being somewhat shorter than that of the resonator walls, is attached to the inner surface of the wall 6, for example by soldering. The attachment edge of the wall 14 has a V-shaped recess 24. Opposite to the angle point of said recess the wall 6 has an opening 6*a*, through which a conductor 26 is lead. Said conductor is connected to the wall 14 at the angle point of the V-shaped opening. The conductor 26 may be a part of a circuit, the other part of which (not shown) being connected to a waveguide and fed by microwave energy therefrom, as described above.

At that side of the resonator, which is opposite to the wall 6, the resonator is provided with ceramic members 40 and 41 located between the walls 4 and 8 and the separating wall 14. The material of said members should have low losses. The heating zones are located in the area immediately outside of the members 40 and 41. The material 42 to be heated is pressed against this area by for example a third, insulating member 43 with low losses. Alternatively a resonator 44 can be arranged parallel to and constructed similarly to the resonator 4, 8, 6, 14 as shown in FIG. 11, and the material 42 to be heated is located between the two resonators. The resonator 44 can be fed in the same way as the resonator 4, 8, 6 14 from the same microwave source or from another microwave source (not shown), which may have another frequency than the first source. When the additional resonator 44 is not fed directly with energy it will still serve as a resonator as energy is transmitted from the fed resonator. The additional resonator not fed directly may have a conductor 26, the outer end of which is short-circuited to the resonator wall 6.

Also other embodiments can be made within the scope of the invention as stated in the attached claims.

What is claimed is:

1. A device for heating material by microwave energy in a longitudinal heating area, comprising a resonator and a microwave energy source feeding the resonator, said resonator comprising a longitudinal cavity limited by walls (2,4,6,8), one (2) of said walls having a longitudinal slot (16), said resonator also comprising a separating wall (14) shorter than the cavity and having one edge attached to the wall (6) opposite to the slot (16), said separating wall (14) being parallel to the slot and extending from the wall (6) towards said slot and thereby dividing at least a part of the cross section surface of the cavity into two chambers, said separating wall (14) also being provided with a feeding device comprising at least one conductor (26) inserted through an opening in the resonator wall (6) and connected to the separating wall (14), the conductor (26), as seen in cross section through the resonator, is arranged symmetrically to the separating wall (14) and connected to a portion (24) of that edge of the wall (14) which is turned to the resonator wall (6) where the conductor (26) is attached and which edge portion (24) is free from said resonator wall, whereby a magnetic field will be generated closing itself around said separating wall (14) in the resonator, and a corresponding electric field will be generated between the edges of the slot (16) and the free edge of the separating wall.

2. A device according to claim 1, wherein each such free edge portion (24) of the separating wall (14) where a conductor (26) is connected, has the shape of a recess (24), the conductor (26) being connected to the bottom of said recess (24).

3. A device according to claim 2, wherein each said recess (24) in the separating wall (14) is V-shaped and that each conductor (26) is connected to the angle point of the V.

4. A device according to claim 1 wherein each conductor (26) is part of a circuit, the other part of which comprising another conductor inserted in a part (**30*a*) of a wave guide (30**) located close to the resonator and by which the resonator is fed by microwave energy from a microwave energy source.

5. A device according to claim 4, wherein said wave guide (**30*a*) is the upper, horizontal part of a wave guide T, said part being located parallel to the resonator and immediately adjacent to that resonator wall, to which the separating wall (14**) is attached.

6. A device according to claim 1 wherein the resonator has two additional chambers (38,39) parallel to the chambers (10,12) separated by the wall (14), each of said additional chambers (38,39) having a slot, whereby said chambers are open towards each other and also towards said slot, provided between the two firstmentioned chambers (10,12), one additional slot (16) being provided between the edges of the slots of said additional chambers (38,39) situated farthest away from said first slot, into which additional slot (16) the material (**16*a***) to be heated can be inserted.

7. A device according to claim 1 including two resonators parallel to each other and situated with their slots opposite to and at a certain distance from each other, the space between the slots being used as a heating zone for the material (34) to be heated.

8. A device according to claim 7, wherein the two resonators are fed from one of a common microwave energy source or independent microwave energy sources having different frequencies.

9. A device according to claim 7, wherein only one of the resonators is fed from a microwave energy source while the other resonator either is not provided with any feeding conductor, or has at least one conductor shortcircuited to the resonator cover outside of the resonator.

10. A device according to claim 1 wherein the chambers (10,12) separated by the separating wall (14) of the resonator are provided with elements (17,19, 44, 45) for leading away heat from the heating area.

11. A device according to claim 10, wherein said elements comprise long metal walls (17,19) parallel to the heating area.

12. A device according to claim 11 wherein said metal walls (17,19) are substantially perpendicular to the electric field in said chambers (10,12) and have not conductive connection to the walls of said chambers.

13. A device according to claim 11 wherein each of said metal walls (17,19) are provided with a tube (44,45) at a longitudinal edge for a cooling medium.

14. A device according to claim 1 wherein the slots of the resonator are at least partly filled with a material with low losses.

15. A device according to claim 1 wherein the separating wall (14) consists of a metallic plate, the width of which being constant along the heating area except for those parts, where said conductors (26) are connected.

* * * * *